US006683822B2

(12) United States Patent
Cheng

(10) Patent No.: US 6,683,822 B2
(45) Date of Patent: Jan. 27, 2004

(54) TIME DISPLAY DEVICE

(76) Inventor: Chin-Shuei Cheng, 6F, No. 12, Lane 46, Sec. 1, Wen Hua Rd., Panchiao City, Taipei Hsien (TW)

( * ) Notice: Subject to any disclaimer, the term of this patent is extended or adjusted under 35 U.S.C. 154(b) by 240 days.

(21) Appl. No.: 10/000,358

(22) Filed: Dec. 4, 2001

(65) Prior Publication Data

US 2003/0103419 A1 Jun. 5, 2003

(51) Int. Cl.[7] ..... G04C 17/02; G04C 19/02

(52) U.S. Cl. ..... 368/240; 368/83; 368/84; 368/241; 368/242

(58) Field of Search ..... 368/82–84, 239, 368/240, 241, 242

(56) References Cited

U.S. PATENT DOCUMENTS

| | | | | |
|---|---|---|---|---|
| 3,754,392 | A | * | 8/1973 | Daniels |
| 3,922,847 | A | * | 12/1975 | Culley et al. |
| 3,958,409 | A | * | 5/1976 | Manber |
| 4,007,583 | A | * | 2/1977 | Johnson |
| 4,041,692 | A | * | 8/1977 | Marshino |
| 4,198,810 | A | * | 4/1980 | Fahrenschon |
| 4,204,399 | A | * | 5/1980 | Heynisch |
| 4,367,959 | A | | 1/1983 | Wiget |
| 4,370,068 | A | | 1/1983 | Han |
| 4,385,842 | A | | 5/1983 | Wiesner |
| 4,459,034 | A | | 7/1984 | Kawabata et al. |
| 4,920,524 | A | | 4/1990 | Kotob |
| 5,410,520 | A | | 4/1995 | Stampfer |
| 5,818,798 | A | | 10/1998 | Luchun |
| 5,896,348 | A | | 4/1999 | Lyon |

FOREIGN PATENT DOCUMENTS

| | | | |
|---|---|---|---|
| GB | 2204429 | A | 11/1988 |

* cited by examiner

*Primary Examiner*—David Martin
*Assistant Examiner*—Jeanne-Marguerite Goodwin
(74) *Attorney, Agent, or Firm*—Rabin & Berdo, P.C.

(57) ABSTRACT

The invention provides an enhanced structure of a time display device includes a circle with 60 display units on the circumference of the clock face, among which 12 display units are made larger for displaying hour of time (hour display units) and the rest (smaller ones) displaying minute of time (minute display units). The display units are made with materials that shine or flicker to indicate time in the dark. To indicate hour of time, a given hour display unit and the two minute display units right next to this hour display unit would be switched on. To indicate minute of time, one of the minute display units would be switched on. While a given display unit has to indicate hour and minute at the same time, it flickers.

9 Claims, 2 Drawing Sheets

TIME DISPLAY DEVICE

BACKGROUND OF THE INVENTION

1. Field of the Invention

The invention relates of a time display device, especially to a clock or a watch with a circle of 60 display units on the circumference of the face, among which 12 display units are made larger for displaying hour of time (hour display units) and the rest (smaller ones) displaying minute of time (minute display units). To indicate hour of time, a given hour display unit and the two minute display units right next to this hour display unit would be switched on. To indicate minute of time, one of the 60 display units would be switched on. While a given display unit has to indicate hour and minute at the same time, it flickers.

2. Description of the Prior Art

It is known that conventional time display device having 12 display units on the circumference of the clock face with minute hand and hour hand indicating time. Or electronic watch (clock) with liquid crystal display indicates time in digital or other manner.

However, the electric watch or clock presents time in digital way, such as U.S. Pat. Nos. 4,920,524, 3,922,847, 4,041,692, 5,896,348, 3,958,409, and GB2204429, all includes three circular arrays of twelve, sixty and sixty LEDs respectively used to indicate hour, minute, and second. Refer to U.S. Pat. Nos. 4,385,842, 3,754,392, there are only two groups of LEDs arranged in circulation for showing hour, minute and second. The above mentioned numerous numbers of circular LEDs for indicating hour, minute and second increase the manufacturing cost thus reduce the competitiveness in market.

In U.S. Pat. No. 4,367,959, a plurality of display elements are arranged circularly and divided the cell into 48 equivalents, a single display element for certain value of the numerical signal while the adjacent elements for other values. However, such kind of display method is anti-conventional for users to interpret the display element and users need to learn new rules for reading time. In U.S. Pat. No. 4,459,034, the dislay of the invention is divided into two parts-main display portion and auxiliary display portion, each having 24 liquid crystal display element arranged in circulation. The watch face is divided into more equivalents thus become more complicated and requires more display elements which increases the difficulty on signal controlling. Users also need to learn new rules of interpreting time.

In U.S. Pat. No. 4,370,068, twelve roundness indicators are positions in circulation to indicate the hour. The ribbony second indicators are used to indicate minute in 5-minute increment. Adjacent to the first indicator is the third rhombus indicator comprising 4 triangular units selectively showing increments of one, two, three or four minutes past the displayed 5-minute increment. This is also an indirect way for users to read time.

In U.S. Pat. No. 5,818,798, the display includes two columns of a dozen hourly indicators indicating the current hour with a ring of sixty minute indicators located around the perimeter of the display. Users need to count the both indicators.

In U.S. Pat. Nos. 4,198,810, and 4,204,399, a multidigit display in the center face with a plurality of segments surrounding the multidigit display. Yet the digits with light spots for representing time is not only increasing the difficulty in controlling but also raising the manufacturing cost.

In U.S. Pat. No. 5,410,520, a timepiece combines analog and digital displays in a format. The face includes two groups of LCDs (liquid crystal display) arranged on the peripheral of the timepiece representing the hour and the minute respectively. Simulated analog hands can be provided as well. Although the numerals provided digital accuracy, the invention also has trouble in controlling.

In U.S. Pat. No. 4,007,583, only twelve indicator elements are arranged circular on timepiece and showing different time units by different kind of optical output such as steady and blinking illumination. While such kind of method is a coarse indication of minutes (5 minute increments) without precisely showing more detailed time.

The present invention improves on the heretofore known time display device by providing a circle of 60 display units on the circumference of the clock face for indicating minute and hour of time. Among the display units, 12 are made larger for displaying hour of time. The rest are smaller and for displaying minute of time. To indicate hour of time, one of the 12 hour display units and the two minute display units next to this hour display unit would be switched on. To indicate minute of time, one of the 60 display units would be switched on. While the minute display unit is also the one displaying the hour of time, the display unit flickers.

SUMMARY OF THE INVENTION

It is therefore a primary object of the invention to provide a time display device with 12 hour display units for displaying hour of time. Four minute display units are set between every two consecutive hour display units. To display hour of time, one of the hour display units would be switched on along with the two minute display units right next to this hour display unit. The other display unit that is switched on indicates minute of time. A time display device of this kind is easy to read and of low cost for manufacturing.

BRIEF DESCRIPTION OF THE DRAWINGS

The accomplishment of the above-mentioned object of the present invention will become apparent from the following description and its accompanying drawings which disclose illustrative an embodiment of the present invention, and are as follows.

DESCRIPTION OF THE PREFERRED EMBODIMENT

Figure 1:
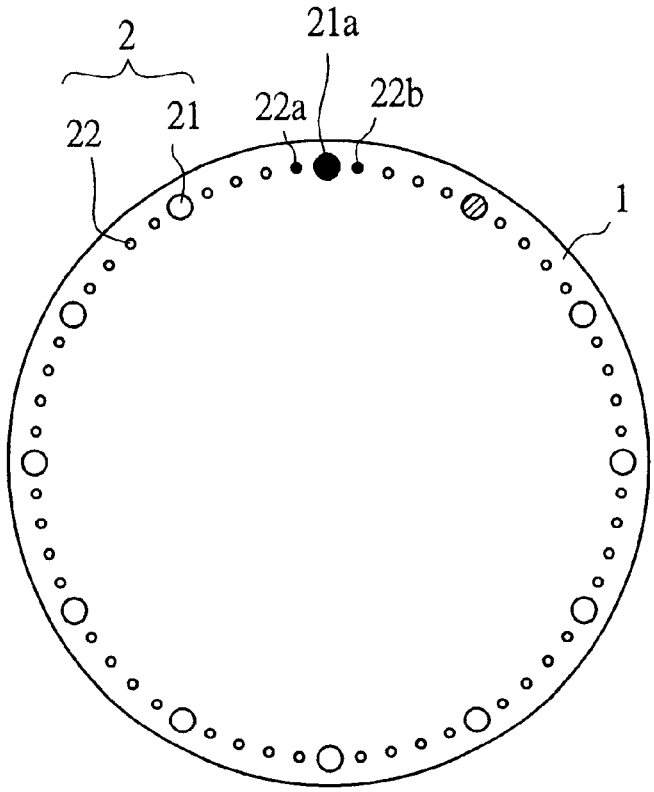
FIG. 1 is a top plan view of a time display device in accordance with the present invention.
Figure 2:
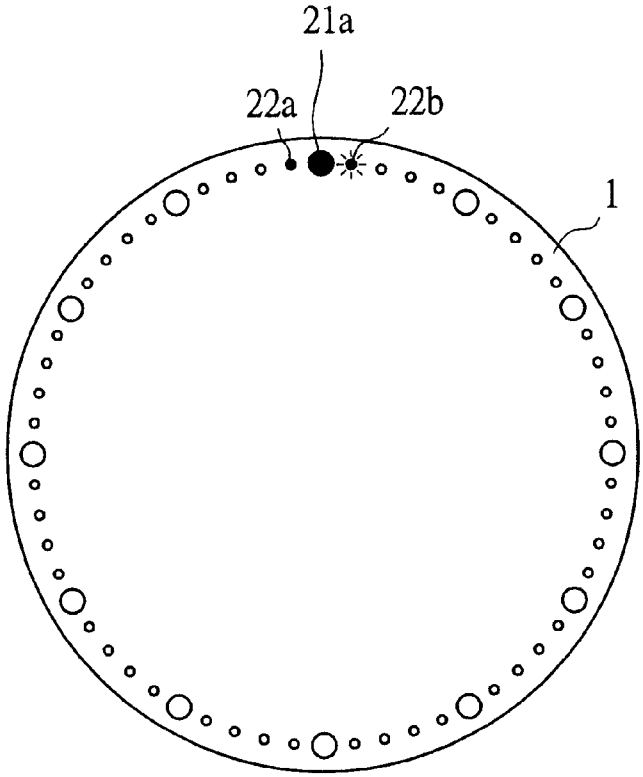
FIG. 2 is a perspective view of the present invention when the minute display unit is also the one displaying the hour of time.

Referring to FIG. 1 and FIG. 2, the present invention comprises a circle of 60 display units (2) on the circumference of a clock face, among which 12 larger units are hour display units (21) and the rest smaller ones are minute display units (22).

To indicate hour of time, one (21*a*) of the 12 hour display units (21) and the minute display units (22*a*, 22*b*) right next to this hour display unit would be switched on. The rest one of the hour display units (21) or the minute display units (22) would be switched on as an indicator of minute of time, as shown in FIG. 1 (showing time is five past twelve).

If the display unit has to display hour and minute of time simultaneously, refer to FIG. 2, showing time is one past twelve, one hour display unit (21*a*) with two minute display units (22*a*, 22*b*) are lighted for indicating hour. The minute display units (22*b*) flickers for displaying both the hour and the minute simultaneously. This lightening pattern makes it easy for users to read time.

Since there is only a circle of display units in the present invention, only 12 larger hour display units (21) and 48 smaller minute display units (22) are needed, and thus the circuit plan can be simplified to lower the cost without sacrificing the accuracy of time displaying.

Further, the hour display units (21) and the minute display units (22) can be made with materials such as LED, LCD, light bulb, or neon that shines or flickers in the dark. The lightening pattern can be 12 hour display units (21) give weak light with hour and minute display units showing present time giving stronger light. It can be 60 display units (2) give weak light while hour and minute display units indicating present time give stronger light. It can also be only hour and minute display units flickering in the dark and all 60 display units (2) give light.

It should be noted that the above description and accompanying drawings are only used to illustrated some embodiments of the present invention, not intended to limit the scope thereof. Any modification of the embodiments should fall within the scope of the present invention.

What is claimed is:

1. A time display device comprising a circle of 60 display units having 12 larger units and 48 smaller units arranged on the circumference of a clock face, wherein said larger units are hour display units and said smaller ones are minute display units; for indicating hour of time, one of said hour display units and two of said minute display units right next to the hour display unit are switched on while another one of said minute display units or said hour display units is also switched on as an indicator of minute of time; if said minute display unit or said hour display unit has to display hour and minute of time simultaneously, said minute display unit or said hour display unit flickers.

2. A time display device as claimed in claim 1, wherein said 60 display units are LEDs (light-emitting diode).

3. A time display device as claimed in claim 1, wherein each of said 60 display units includes at least one LED.

4. A time display device as claimed in claim 1, wherein said 60 display units can be installed on a LCD.

5. A time display device as claimed in claim 1, wherein said 60 display units are bulbs.

6. A time display device as claimed in claim 1, wherein said 60 display units are neon.

7. A time display device as claimed in claim 1, wherein said 12 hour display units all give weak light with said hour and minute display units indicating present time giving stronger light for the convenience of reading time at night.

8. A time display device as claimed in claim 1, wherein said 60 display units all give weak light with said hour and minute display units indicating present time giving stronger light for the convenience of reading time at night.

9. A time display device as claimed in claim 1, wherein said 60 display units are all lighted and said hour and minute display units indicating present time flicker.

* * * * *